US006650992B2

(12) United States Patent
Jankovic et al.

(10) Patent No.: US 6,650,992 B2
(45) Date of Patent: Nov. 18, 2003

(54) SYSTEM AND METHOD FOR SELECTING A CAMSHAFT IN AN ENGINE HAVING DUAL CAMSHAFTS

(75) Inventors: Mrdjan J. Jankovic, Birmingham, MI (US); Stephen Lee Cooper, Dearborn, MI (US); Stephen William Magner, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 222 days.

(21) Appl. No.: 10/045,228

(22) Filed: Nov. 9, 2001

(65) Prior Publication Data

US 2003/0093214 A1 May 15, 2003

(51) Int. Cl.[7] ..... F01L 1/344; F02D 45/00
(52) U.S. Cl. ..... 701/111; 123/90.17
(58) Field of Search ..... 701/111, 102, 701/115; 123/436, 90.17, 90.18

(56) References Cited

U.S. PATENT DOCUMENTS 5,245,968 A 9/1993 Kolias et al.
6,219,611 B1 4/2001 Russell

*Primary Examiner*—Andrew M. Dolinar
(74) *Attorney, Agent, or Firm*—John Buckert; Allan J. Lippa

(57) ABSTRACT

A system and method for selecting one of first and second camshafts in an engine is provided. The first and second camshafts control air flow communicating with the first and second cylinders, respectively, of the engine. The engine includes a crankshaft being driven by first and second pistons with the first and second cylinders. The method includes determining which of the first and second camshafts is moving at a faster rate of movement toward a first scheduled phase angle with respect to the crankshaft. Finally, the method includes selecting one of the first and second camshafts having the faster rate of movement for reducing engine torque fluctuations.

10 Claims, 6 Drawing Sheets

SYSTEM AND METHOD FOR SELECTING A CAMSHAFT IN AN ENGINE HAVING DUAL CAMSHAFTS

FIELD OF THE INVENTION

The invention relates to a system and method for selecting a camshaft in an engine having dual camshafts to reduce engine torque fluctuations.

BACKGROUND OF THE INVENTION

Known engines have utilized variable cam timing (VCT) mechanisms to control the opening and closing of intake valves and exhaust valves communicating with engine cylinders. In particular, each VCT mechanism is utilized to adjust a position of a camshaft (which actuates either an intake valve or exhaust valve or both) with respect to a crankshaft position. By varying the position of the camshaft (i.e., camshaft angle) with respect to the position of the crankshaft, engine fuel economy can be increased and engine emissions can be decreased.

In known engines having VCT mechanisms, it is desired to shift the position of camshafts in the VCT mechanisms synchronously (i.e., at the same speed) to a desired phase angle with respect to the crankshaft. However, the inventors herein have recognized that first and second camshafts associated with first and second VCT mechanisms, respectively, in an engine, may not move to the desired phase angle at the same speed. For example, the first VCT mechanism may be actuated at a lower pressure that a second VCT mechanism due to a clogged oil line communicating with the first VCT, resulting in slower movement of the first camshaft. Still further, the first VCT mechanism may "stick" at cold temperatures resulting in slower movement of the first camshaft as compared to the second camshaft of the second VCT mechanism. During non-synchronous movement of the first and second camshafts, the air charge delivered to first and second cylinder banks, respectively, are different. The difference in air charge can result in a differing torques being produced by the first and second cylinder banks resulting in undesirable engine shaking and increased engine noise.

The inventors herein have recognized that there is a need for a system and method for selecting one of the first and second camshafts when attempting to reduce engine torque fluctuations. In particular, the inventors herein have recognized that a first camshaft moving at a slower speed than a second camshaft toward a scheduled phase angle—cannot physically move faster to reduce engine torque fluctuations. Therefore, the faster camshaft must be selected when modifying the speed of one of the camshafts to reduce engine torque fluctuations.

SUMMARY OF THE INVENTION

The foregoing problems and disadvantages are overcome by a system and method for selecting one of first and second camshafts in a variable cam timing engine. The first and second camshafts control air flow communicating with first and second cylinders, respectively, of the engine. The engine further includes a crankshaft driven by first and second pistons within the first and second cylinders, respectively. The method includes determining which of the first and second camshafts is moving at a faster rate of movement toward a first scheduled phase angle with respect to the crankshaft. Finally, the method includes selecting one of the first and second camshafts having the faster rate of movement for reducing engine torque fluctuations.

A system for selecting one of first and second phase shiftable camshafts in a variable cam timing engine is also provided. The system includes a first sensor generating a first signal indicative of a position of the first camshaft. The system further includes a second sensor generating a second signal indicative of a position of the second camshaft. The system further includes a third sensor generating a third signal indicative of a position of a crankshaft. Finally, the system includes a controller configured to determine which of the first and second camshafts is moving toward a first scheduled phase angle with respect to the crankshaft at a faster rate of movement based on the first, second, and third signals. The controller is further configured to select one of the first and second camshafts having the faster rate of movement for reducing torque fluctuations when changing the faster rate of movement.

The inventive system and method for selecting one of first and second camshafts of an engine solves the problem of which camshaft to use to reduce engine torque fluctuations. In particular, the inventive system and method selects the faster camshaft when modifying the speed of one of the camshafts to reduce engine torque fluctuations.

DESCRIPTION OF EMBODIMENTS

Figure 1:
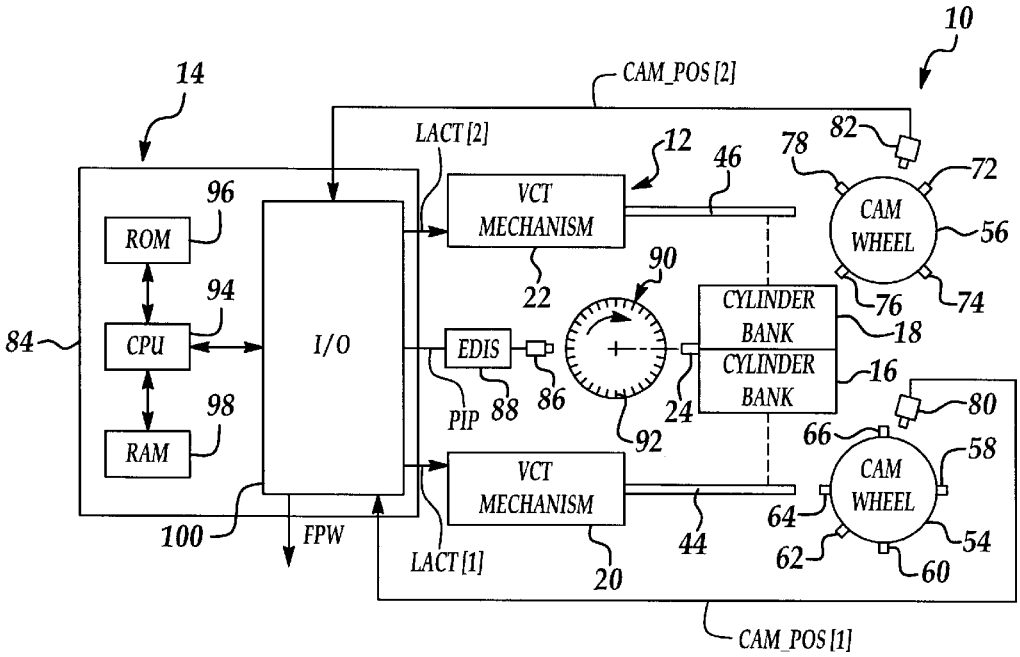
FIG. 1 is block diagram of an automotive vehicle having two VCT mechanisms and a control system for controlling the mechanisms.

Referring now to the drawings, like reference numerals are used to identify identical components in the various views. Referring to FIG. 1, an automotive vehicle 10 having an engine 12 and a control system 14 is illustrated.

Figure 2:
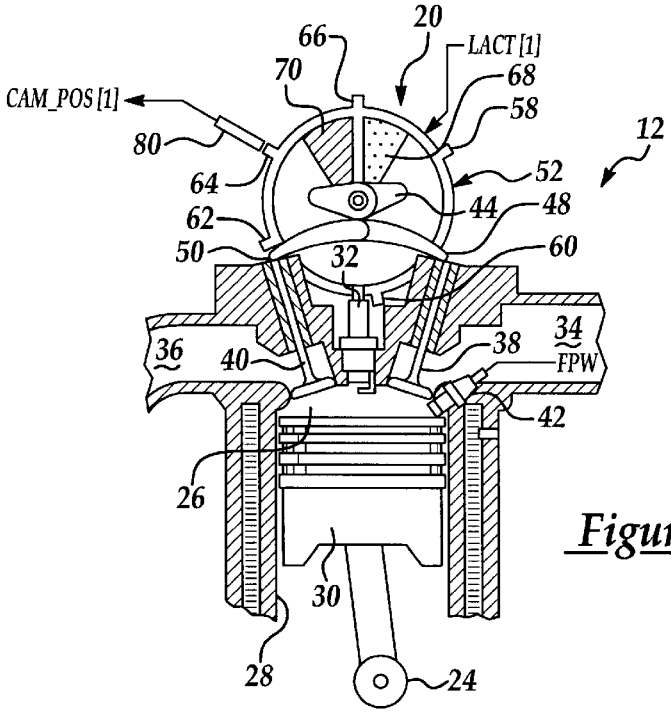
FIG. 2 is a cross-section view of one of the VCT mechanisms shown in FIG. 1.

Engine 12 includes cylinder banks 16, 18 VCT mechanisms 20, 22 and a crankshaft 24. Referring to FIG. 2, each of cylinder banks 16, 18 may have a plurality of cylinders, however, one cylinder of cylinder bank 16 is shown along with VCT mechanism 20 for purposes of simplicity. As illustrated, engine 12 further includes a combustion chamber 26, cylinder walls 28, a piston 30, a spark plug 32, an intake manifold 34, an exhaust manifold 36, an intake valve 38, an exhaust valve 40, and a fuel injector 42.

As used herein, the term "cylinder bank" refers to a related group of cylinders having one or more common characteristics, such as being located proximate one another or having a common emission control device (ECD), intake manifold, and/or exhaust manifold for example. This would include configurations having a group of cylinders on the same side of engine treated as a bank even though these cylinders may not share a common intake or exhaust manifold (i.e., the exhaust manifold could be configured with separate exhaust runners or branches if desired or beneficial). Similarly, cylinder banks can also be defined for in-line cylinder configurations which are within the scope of this invention.

Referring to FIGS. 1 and 2, VCT mechanisms 20, 22 are provided to actuate intake/exhaust valves in cylinder banks 16, 18. For example, as shown in FIG. 2, VCT mechanism 20 is utilized to actuate intake valve 38 and exhaust valve 40 of a cylinder associated with cylinder bank 16 to control air flow entering the cylinder and exhaust gases exiting the cylinder, respectively. VCT mechanism 20 cooperates with a camshaft 44, which is shown communicating with rocker arms 48, 50 for variably actuating valves 38, 40. Camshaft 44 is directly coupled to housing 52. Housing 52 forms a toothed cam wheel 54 having teeth 58, 60, 62, 64, 66. Housing 52 is hydraulically coupled to an inner shaft (not shown), which is in turn directly linked to camshaft 44 via a timing chain (not shown). Therefore, housing 52 and camshaft 44 rotate at a speed substantially equivalent to the inner camshaft. The inner camshaft rotates at a constant speed ratio to crankshaft 24. However, by manipulation of the hydraulic coupling will be described later herein, the relative position of camshaft 44 to crankshaft 24 can be varied by hydraulic pressure in advance chamber 68 and retard chamber 70. By allowing high-pressure hydraulic fluid to enter advance chamber 68, the relative relationship between camshaft 44 and crankshaft 24 is advanced. Thus, intake valve 38 and exhaust valve 40 open and close at a time earlier than normal relative to crankshaft 24. Similarly, by allowing high-pressure hydraulic fluid to enter retard chamber 70, the relative relationship between camshaft 44 and crankshaft 24 is retarded. Thus, intake valve 38 and exhaust valve 40 open and close at a time later than normal relative to crankshaft 24.

VCT mechanism 22 may include like components as illustrated for VCT mechanism 20 and may be hydraulically actuated as discussed above with reference to mechanism 20. In particular, VCT mechanism 22 includes cam wheel 56 and teeth 72, 74, 76, 78 disposed around the outer surface of the housing of mechanism 22.

Teeth 58, 60, 64, 66 of cam wheel 54 are coupled to housing 52 and camshaft 44 and allow for measurement of relative position of camshaft 44 via cam timing sensor 80 which provides signal CAM_POS[1] to controller 84. Tooth 62 is used for cylinder identification. As illustrated, teeth 58, 60, 64, 66 may be evenly spaced around the perimeter of cam wheel 54. Similarly, teeth 72, 74, 76, 78 of cam wheel 56 are coupled to cam wheel 56 and camshaft 46 and allow for measurement of relative position of camshaft 46 via cam timing sensor 82 which provides signal CAM_POS[2] to controller 84. Teeth 72, 74, 76, 78 of cam wheel 56 may also be equally spaced around the perimeter of wheel 56 for measurement of camshaft timing.

Referring to FIGS. 1 and 2, controller 84 sends control signal LACT[1] to a conventional solenoid spool valve (not shown) to control the flow of hydraulic fluid either into advance chamber 68, retard chamber 70, or neither of VCT mechanism 20. Similarly, controller 84 sends a control signal LACT[2] to another spool valve (not shown) to control VCT mechanism 22.

Relative position of camshaft 44 is measured in general terms, using the time, or rotation angle between the rising edge of a PIP signal (explained in greater detail below) and receiving a signal from one of the teeth 58, 60, 64, 66. Similarly, the position of camshaft 46 is measured using the time, or rotation angle between the rising edge of the PIP signal and receiving a signal from one of the teeth 72, 74, 76, 78. For the particular, example, of a V-8 engine, with two cylinder banks and a five-toothed cam wheel 54, a measured of cam timing for a camshaft 44 is received four times per revolution, with the extra signal used for cylinder identification. A detailed description of the method for determining relative position of the camshafts 44, 46 is described in commonly assigned U.S. Pat. No. 5,245,968 which is incorporated by reference herein in its entirety.

Referring again to FIG. 2, combustion chamber 26 communicates with intake manifold 34 and exhaust manifold 36 via respective intake and exhaust valves 38, 40. Piston 30 is positioned within combustion chamber 26 between cylinder walls 28 and is connected to crankshaft 24. Ignition of an air-fuel mixture within combustion chamber 26 is controlled via spark plug 32 which delivers ignition spark responsive to a signal from a distributorless ignition system (not shown).

Intake manifold 34 is also shown having fuel injector 42 coupled thereto for delivering fuel in proportion to the pulse width of signals (FPW) from controller 84. Fuel is delivered to fuel injector 42 by a conventional fuel system (not shown) including a fuel tank, fuel pump, and fuel rail (now shown). Although port fuel injection is shown, direct fuel injection could be utilized instead of port fuel injection.

Referring to FIG. 1, control system 14 is provided to control the operation of engine 12 and to implement a method for controlling VCT mechanisms 20, 22 in accordance with the present invention. Control system 14 includes camshaft position sensors 80, 82, crankshaft position sensor 86, ignition system controller 88, and engine controller 84.

Camshaft position sensors 80, 82 are provided to generate signals indicative of a position of camshafts 44, 46, respectively. Sensors 80, 82 are conventional in the art and may comprise hall-effect sensors, optical encoders, or variable reluctance sensors. As cam wheel 54 rotates, teeth 58, 60, 64, 66 equally spaced at ninety degrees (when engine 12 is a V8 engine for example) around the wheel 54 pass by sensor 80. The sensor 80 senses the passing of each tooth and generates respective electric cam pulses or position signals CAM_POS[1] which are received by controller 84. Similarly, as cam wheel 56 rotates, teeth 72, 74, 76, 78 pass by sensor 82 which generates respective electric cam pulses or position signals CAM_POS[2] which are received by controller 84.

The crankshaft position sensor 86 is provided to generate a signal indicative of a position of crankshaft 24. Sensor 86 is conventional in the art and may comprise a hall effect sensor, an optical sensor, or a variable reluctance sensor. A camshaft sprocket 90 is fixed to crankshaft 24 and therefore rotates with crankshaft 24. Sprocket 90 may include thirty-five gear teeth 92 spaced ten degrees apart which results in one tooth missing that sensor 86 uses for sensing the position of sprocket 90. The sensor 86 generates position signal CS_POS that is transmitted to ignition system controller 88. Controller 88 converts the signal CS_POS into the PIP signal which is then transmitted to engine controller 84. A PIP pulse occurs at evenly spaced rotational intervals of crankshaft 24 with one pulse per cylinder per engine cylinder cycle. This series of pulses comprise the PIP signal.

The engine controller 84 is provided to implement the method for controlling VCT mechanisms 20, 22 and in particular, for controlling the position of camshafts 44, 46. Further, controller 84 is provided to compare signal CAM_POS[1] to signal PIP to determine a relative position (i.e., phase angle) of camshaft 44 with respect to crankshaft 24. Similarly, controller 84 compares signal CAM_POS[2] to signal PIP to determine a relative position of camshaft 46 with respect to crankshaft 24. As illustrated, controller 84 includes a CPU 94 and a computer readable storage media comprising nonvolatile and volatile storage in a read-only memory (ROM) 96 and a random-access memory (RAM) 98. The computer readable media may be implemented using any of a number of known memory devices such as PROMs, EPROMs, EEPROMs, flash memory or any other electric, magnetic, optical or combination memory device capable of storing data, some of which represent executable instructions, used by microprocessor 94 in controlling engine 12. Microprocessor 94 communicates with various sensors and actuators (discussed above) via an input/output (I/O) interface 100. Of course, the present invention could utilize more than one physical controller to provide engine/vehicle control depending upon the particular application.

Figure 4:
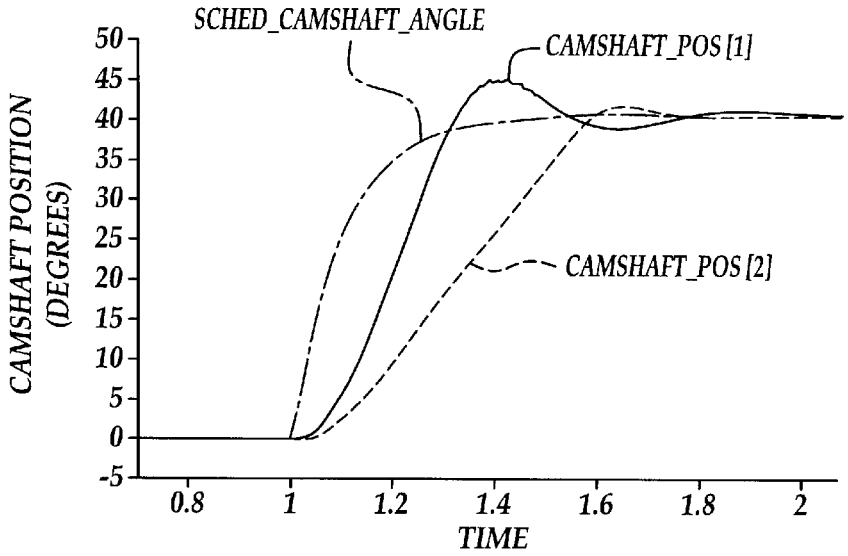
FIG. 4 is a schematic of signals generated by a conventional control system for dual VCT's.

Before discussing the method for controlling VCT mechanisms 20, 22, the problems associated with known VCT systems will be discussed. Referring to FIG. 4, a scheduled camshaft position signal (Sched_camshaft_angle) for both camshafts 44, 46 is shown. In this example, controller 84 is requesting that both camshafts 44, 46 move from a relative position of 0° to 40° with respect to crankshaft 24. As illustrated, the signal Camshaft_pos[1] represents the movement of camshaft 44 and signal Camshaft_pos[2] represents the movement of camshaft 46. As shown in this example, the camshaft 44 is moving faster toward the desired phase angle than the camshaft 46. As such, at time T=1.35 seconds, the phase difference between camshafts 44, 46 equals approximately 21°. As discussed above, this phase difference can result in differing torques being produced by cylinder banks 16, 18 resulting in undesirable torque fluctuations and increased engine noise.

Figure 5A:
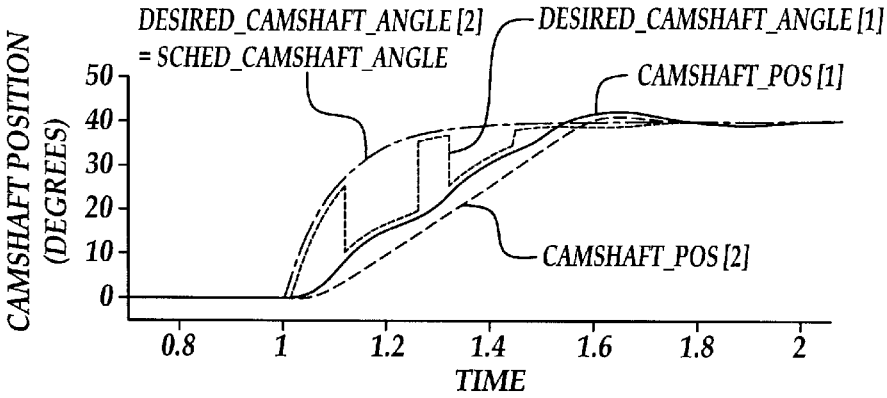
FIGS. 5A–5B are schematics of signals generated by a control system for dual VCT's in accordance with the present invention.
Figure 5B:
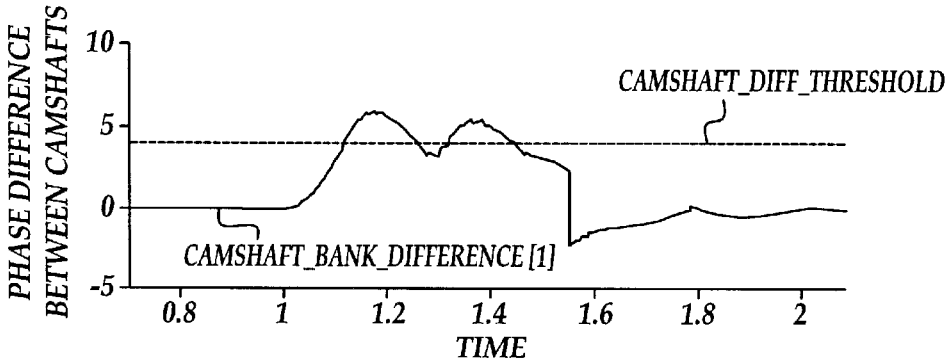

Referring to FIGS. 5A and 5B, the signals used by a method for controlling camshafts 44, 46 in accordance with the present invention will be discussed. As shown in FIG. 5A, the signals Desired_camshaft_angle[1] represents a commanded position of camshaft 44 over time toward a desired phase angle with respect to crankshaft 24. Similarly, Desired_camshaft_angle[2] represents a commanded position of camshaft 46 over time toward a desired phase angle with respect to crankshaft 24. In this example, controller 84 determines that crankshaft 24 is moving toward the desired phase angle at a faster rate than crankshaft 24. At time T=1.15 seconds when the phase difference between the camshafts 44, 46, represented by the value Camshaft_bank difference[1], becomes greater than the threshold value Camshaft_adjustment_threshold, controller 84 decreases the value Desired_camshaft_angle[1] to slow movement of the faster camshaft 44. Further, because the crankshaft 24 is moving at a slower rate, the commanded position signal Desired_camshaft_angle[2] is not adjusted by the method and corresponds to the calculated Sched_camshaft_angle signal. Thus, the rate of movement of the faster crankshaft 24 approaches the rate of movement of the slower crankshaft 24 resulting in equivalent torques being produced in both cylinder banks 16, 18. Thus, undesirable torque fluctuations and engine noise is reduced and/or eliminated.

Figure 3A:
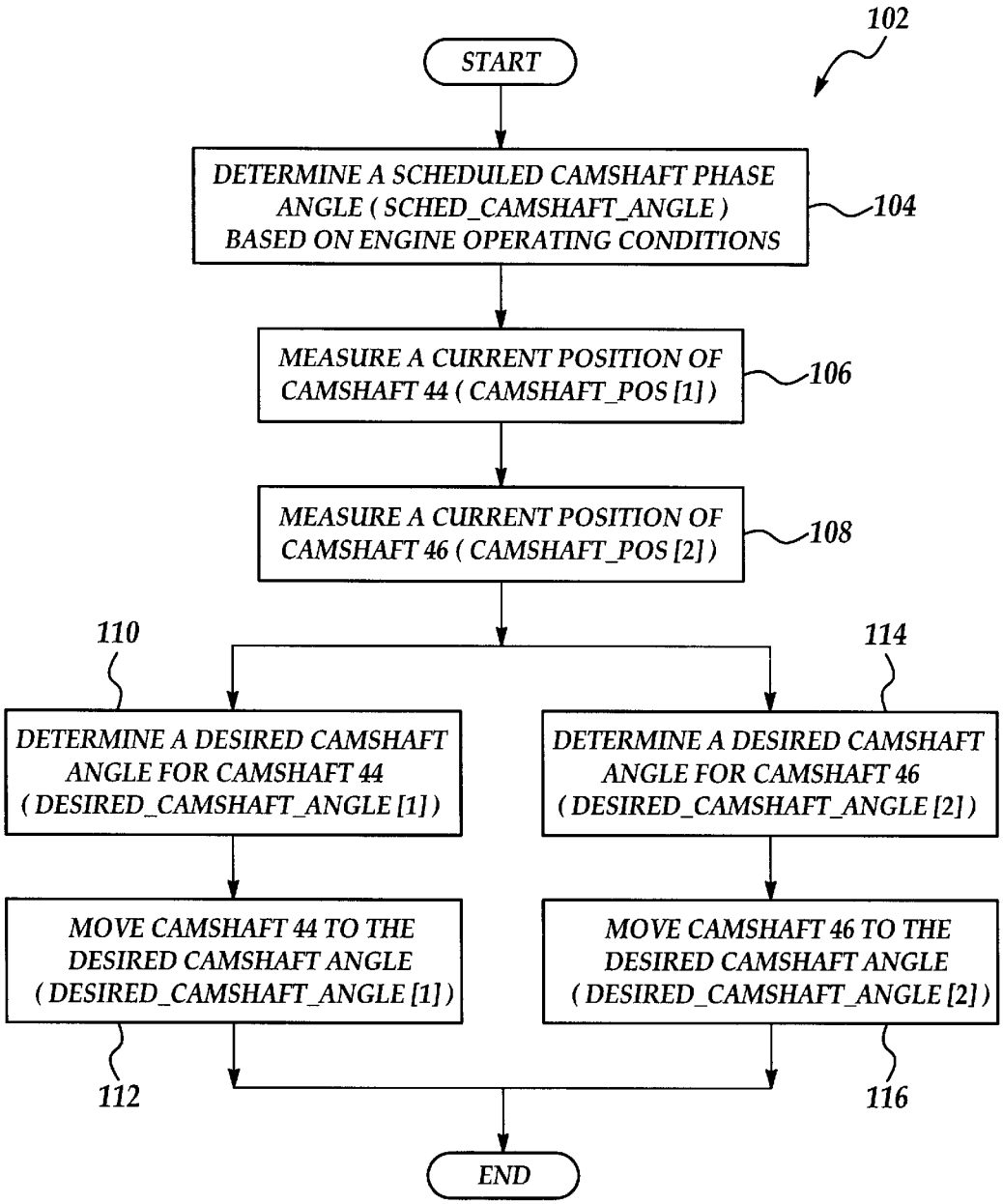
FIGS. 3A–3E are flowcharts of a method of selecting a camshaft in one of dual VCT mechanisms in an engine in accordance with the present invention.

Referring to FIG. 3A, a method 102 for controlling camshafts 44, 46 in accordance with the present invention will be explained. As illustrated, a step 104 determines a scheduled camshaft phase angle (Sched_camshaft_angle) based on engine operating parameters. Those skilled in the art will recognize that the desired camshaft phase angle for camshafts 44, 46 can be determined based on various engine operating parameters. For example, when engine 12 has a mechanically controlled throttle (not shown) controlling air flow into intake manifold 34, controller 84 may utilize a throttle position, engine speed, barometric pressure, air charge temperature, and coolant temperature to determine a scheduled camshaft phase angle from a lookup table. Alternately, for example, when engine 12 has an electronically controlled throttle (not shown) controlling air flow into manifold 34, controller 84 may use an accelerator pedal position and a vehicle speed to determine the schedule camshaft phase angle from a lookup table.

Next at step 106, controller 84 determines the current position (Camshaft_pos[1]) of camshaft 44, based on the signal CAM_POS[1] and the signal PIP.

Similarly, at step 108, controller 84 determines the current position (Camshaft_pos[2]) of camshaft 46 based on the signal CAM_POS[2] and the signal PIP.

Next, controller 84 simultaneously executes steps 110, 112 for controlling camshaft 44 and steps 114, 116 for controlling camshaft 46.

Figure 3B:
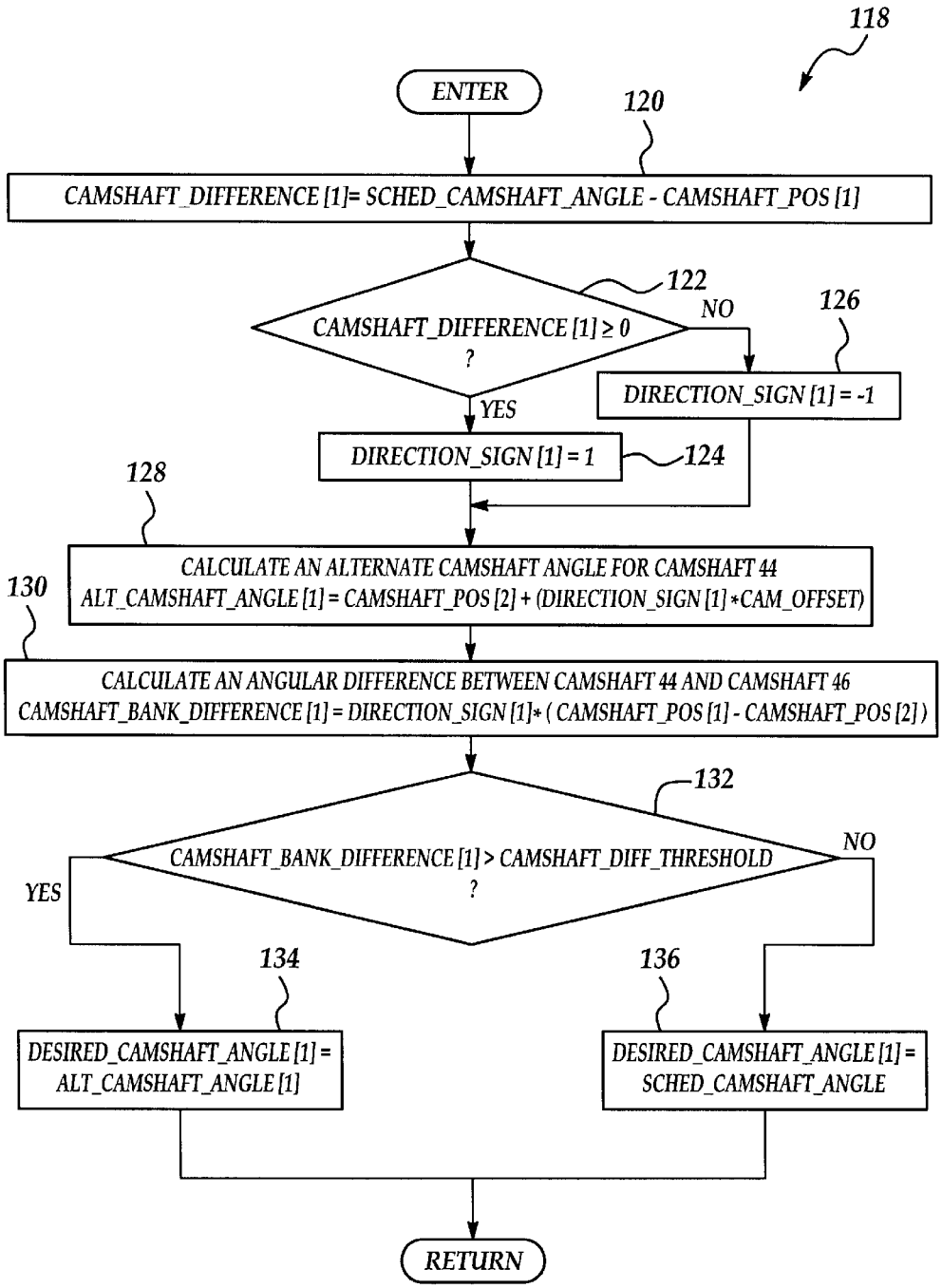

The step 110 determines a desired camshaft phase angle (Desired_camshaft_angle[1]) for camshaft 44. Referring to FIG. 3B, the underlying method 118 for implementing step 110 will now be discussed. As shown, step 120 calculates the value (Camshaft_difference[1]) based on the following equation:

$$\text{Camshaft_difference}[1]=(\text{Sched_camshaft_angle}-\text{Camshaft_pos}[1])$$

where Sched_camshaft_angle represents the commanded position of camshafts 44, 46 based on engine operating parameters.

Camshaft_pos[1] represents the current position of camshaft 44.

Next at step 122, a determination is made as to whether Camshaft_difference[1] is greater than or equal to zero. If the answer to step 122 equals "Yes" indicating camshaft 44 is being advanced from a present position, a step 124 sets the value Direction_sign[1] equal to one. Otherwise, camshaft 44 is being retarded from a present position and a step 126 sets the value Direction_sign[1] equal to negative one.

Next at step 128, an alternate camshaft angle for camshaft 44 is calculated using the following equation:

$$\text{Alt_camshaft_angle}[1]=(\text{Camshaft_pos}[2]+(\text{Direction_sign}[1]*\text{Cam_offset}))$$

where Cam_offset represents a constant angular offset such as 6°. Thus, the value Alt_camshaft_angle[1] for camshaft 44 corresponds to the position of the camshaft 46 plus an offset. As will be discussed below, the value Alt_camshaft_angle[1] will only be used to control camshaft 44 if a phase difference between camshafts 44, 46 exceeds a threshold phase difference.

Next at step 130, an angular difference between camshafts 44, 46 is calculated using the following equation:

$$\text{Camshaft_bank_difference}[1]=\text{Direction_sign}[1]*(\text{Camshaft_pos}[1]-\text{Camshaft_pos}[2])$$

When Camshaft_bank_difference[1] is greater than a predetermined value, such zero for example, it indicates that camshaft 44 is moving at a faster speed than camshaft 46 toward the scheduled camshaft phase angle (Sched_camshaft_angle). Alternately, when Camshaft_bank_difference[1] is less than the predetermined threshold value, it indicates that camshaft 44 is moving at a slower speed than camshaft 46 toward the scheduled camshaft phase angle (Sched_camshaft_angle).

Next at step 132, a determination is made as to whether Camshaft_bank_difference[1] is greater than a value Camshaft_diff_threshold. The Camshaft_diff_threshold may be equal to a constant value such as 4° for example.

When the value of step 132 equals "Yes", the step 134 calculates the value Desired_camshaft_angle[1] using the following equation:

Desired_camshaft_angle[1]=Alt_camshaft_angle[1]

Otherwise, the step 136 calculates the value Desired_camshaft_angle[1] using the following equation:

Desired_camshaft_angle[1]=Sched_camshaft_angle[1]

After either of steps 134, 136, the method advances to step 112.

Figure 3C:
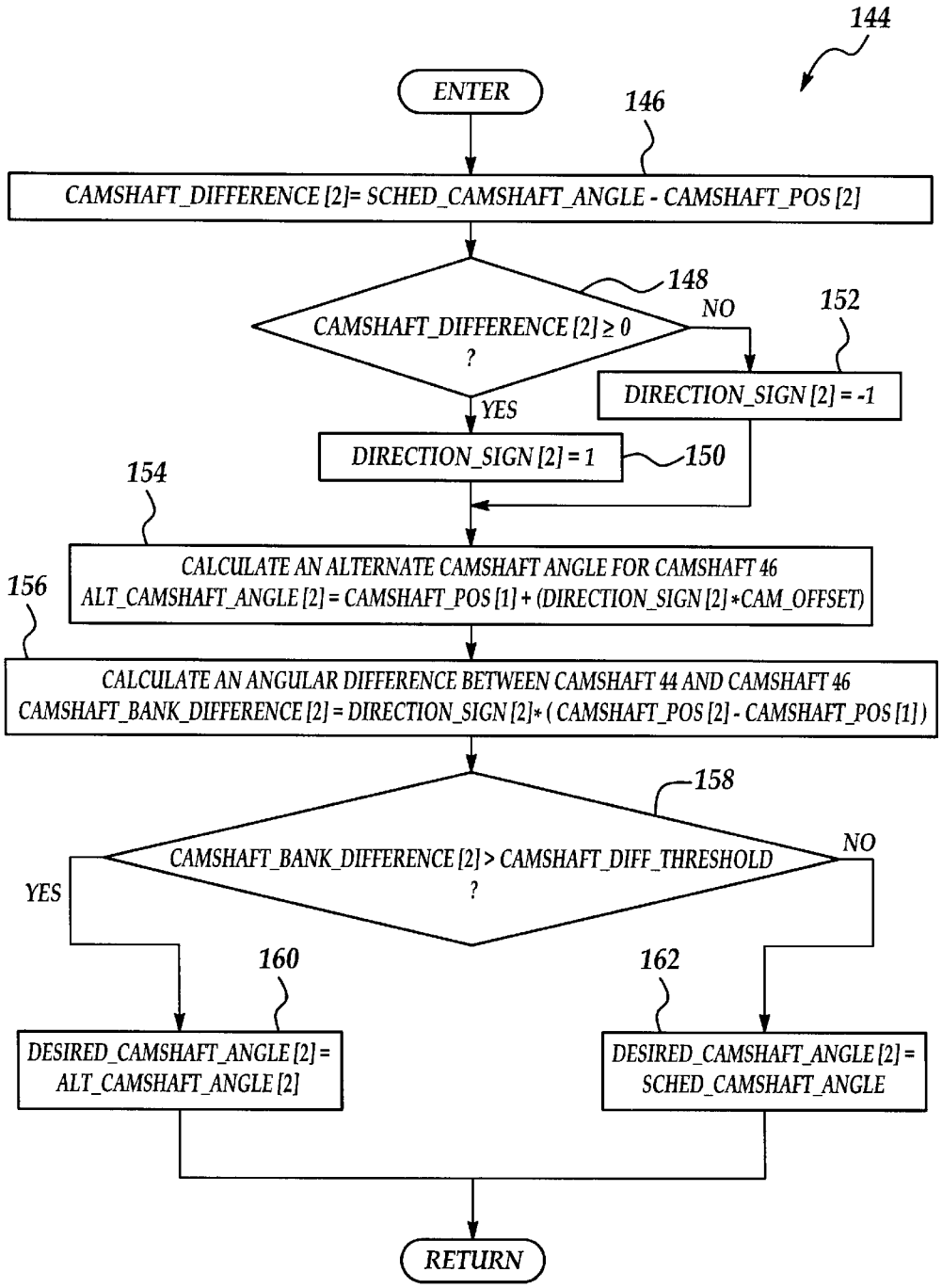
Figure 3D:
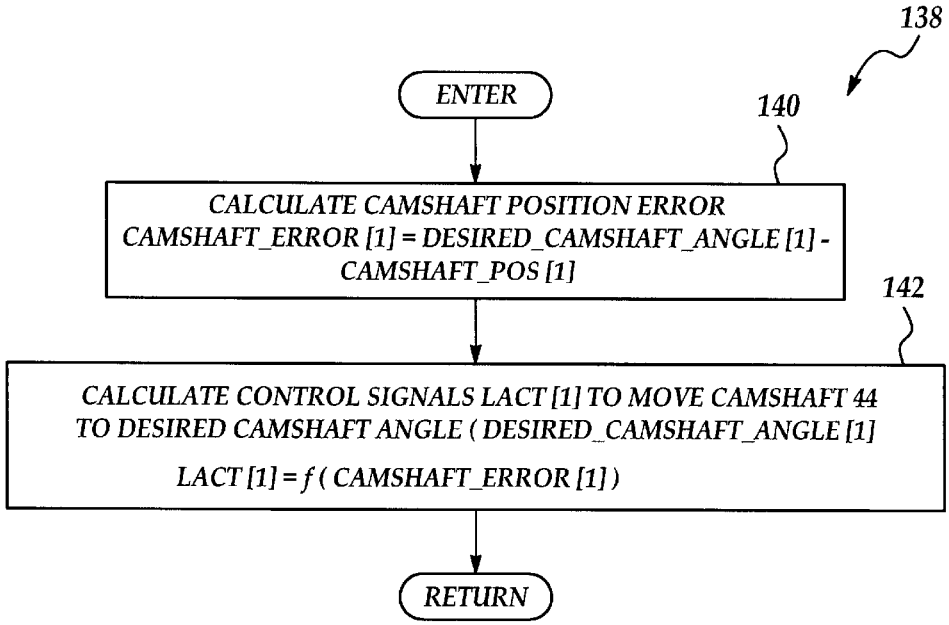

Referring to FIG. 3A, at step 112, the camshaft 44 is moved to a position represented by the value Desired_camshaft_angle[1]. Referring to FIG. 3D, the underlying method 138 for implementing step 112 will now be discussed. At step 140, a camshaft position error is calculated using the following equation:

Camshaft_error[1]=Desired_camshaft_angle[1]−Camshaft_pos[1]]

Next at step 142, control signal LACT[1] is calculated to move camshaft 44 to Desired_camshaft_angle[1]. In particular, the signal LACT[1] is calculated as a function of the camshaft position error using the following equation: LACT[1]=f(Camshaft_error[1]). After step 142, the method 138 is ended.

Referring again to FIG. 3A, the steps 114, 116 are utilized for controlling the position of camshaft 46. At step 114 a desired camshaft phase angle (Desired_camshaft_angle[2]) is determined for camshaft 46. Referring to FIG. 3C, a method 144 for implementing step 114 will now be discussed. As shown, step 146 calculates the value Camshaft_difference[2] based on the following equation:

Camshaft_difference[2]=Sched_camshaft_angle−Camshaft_pos[2]]

where Camshaft_pos[2]=current position of camshaft 46.

Next at step 148, a determination is made as to whether Camshaft_difference[2] is greater than or equal to zero. If the answer to step 148 equals "Yes" indicating camshaft 46 is being advanced from its present position, a step 150 sets the value Direction_sign[2] equal to one. Otherwise, camshaft 46 is being retarded from a present position and a step 152 sets the value Direction_sign[1] equal to negative one.

Next at step 154, an alternate camshaft angle for camshaft 46 is calculated using the following equation:

Alt_camshaft_angle[2]=Camshaft_pos[1]+(Direction_sign[2]*Cam_offset)

where Cam_offset represents a constant angular offset such as 6° for example. Thus, the value Alt_camshaft_angle[2] for camshaft 46 corresponds to the position of camshaft 44 plus an offset.

Next at step 156, an angular difference between camshafts 44, 46 is calculated using the following equation:

Camshaft_bank_difference[2]=Direction_sign[2]*(Camshaft_pos[2]−Camshaft_pos[2])

When Camshaft_bank_difference[2] is greater than a predetermined value, it indicates that camshaft 46 is moving at a faster speed than camshaft 44 toward the scheduled camshaft phase angle (Sched_camshaft_angle). Alternately, when Camshaft_bank_difference[2] is less than the predetermined value, it indicates that camshaft 46 is moving at a slower speed than camshaft 44 toward the scheduled camshaft phase angle (Sched_camshaft_angle).

Next at step 158, a determination is made as to whether Camshaft_bank_difference[2] is greater than the value Camshaft_diff_threshold. As discussed above, the Camshaft_diff_threshold may be equal to a constant value such as 4° for example. When the value of step 158 equals "Yes", the step 160 calculates the value (Desired_camshaft_angle[2]) using the following equation:

Desired_camshaft_angle[2]=Alt_camshaft_angle[2]

Otherwise, the step 162 calculates the value Desired_camshaft_angle[2] using the following equation:

Desired_camshaft_angle[2]=Sched_camshaft_angle

After either of steps 160, 162, the method advances to step 116.

Figure 3E:
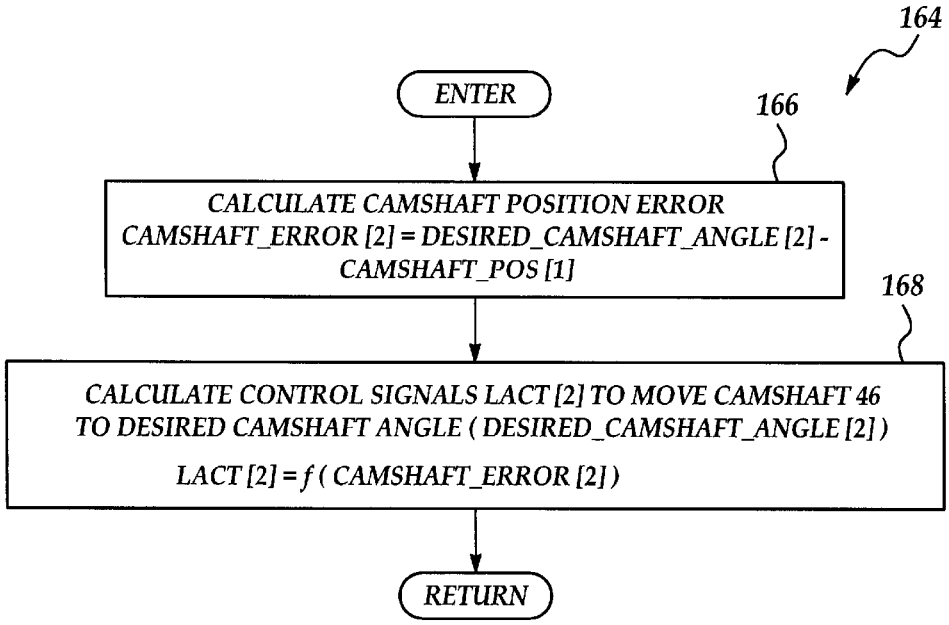

Referring to FIG. 3A, at step 116, the camshaft 46 is moved to a position represented by the value Desired_camshaft_angle[2]. Referring to FIG. 3E, the underlying method 164 for implementing step 116 will now be discussed. At step 166, a camshaft position error is calculated using the following equation:

Camshaft_error[2]=Desired_camshaft_angle[2]−Camshaft_pos[1]

Next at step 168, control signal LACT[2] is calculated to move camshaft 46 to Desired_camshaft_angle[2]. In particular, the signal LACT[2] is calculated as a function of the camshaft position error using the following equation: LACT[2]=f(Camshaft_error[2]). After step 168, the method 164 is ended.

The control system 14 and method 102 for controlling camshafts 44, 46 of VCT mechanisms 20, 22, respectively, provide a substantial advantage over conventional systems and methods. In particular, the system 14 and method 102 selects the faster camshaft when modifying the speed of one of the camshafts to reduce engine torque fluctuations.

We claim:

1. A method for selecting one of first and second phase shiftable camshafts in a variable camshaft timing engine, said first and second camshafts controlling air flow communicating with said first and second cylinders, respectively, of said engine, said engine further including a crankshaft being driven by first and second pistons within said first and second cylinders, respectively, said method comprising:

determining which of said first and second camshafts is moving at a faster rate of movement toward a first scheduled phase angle with respect to said crankshaft; and, selecting one of said first and second camshafts having said faster rate of movement for reducing engine torque fluctuations.

2. The method of claim 1 wherein said determining step includes:

determining whether said first camshaft is being advanced or retarded with respect to a present position of said camshaft;

determining a phase angle difference between said first camshaft and said second camshaft with respect to said crankshaft; and, indicating which one of said first and second camshafts has said faster rate of movement based on said phase angle difference and whether said first camshaft is being advanced or retarded.

3. The method of claim 2 wherein said step of determining whether said first camshaft is being advanced or retarded includes:

measuring a present phase angle of said first camshaft with respect to said crankshaft; and, comparing said present phase angle with a scheduled phase angle of said first camshaft.

4. The method of claim 2 wherein said step of indicating which one of said first and second camshafts has said faster rate of movement includes:

multiplying said phase angle difference value by a positive value if said first camshaft is being advanced or a negative value if said first camshaft is being retarded to obtain a first value, wherein when said first value is greater than a predetermined threshold value said first camshaft has said faster rate of movement.

5. A system for selecting one of first and second phase shiftable camshafts in a variable camshaft timing engine, said first and second camshafts controlling air flow communicating with first and second cylinders, respectively, of said engine, said engine further including a crankshaft being driven by first and second pistons within said first and second cylinders, respectively, said system comprising:

a first sensor generating a first signal indicative of a position of said first camshaft;

a second sensor generating a second signal indicative of a position of said second camshaft;

a third sensor generating a third signal indicative of a position of said crankshaft; and, a controller configured to determine which of said first and second camshafts is moving toward a first scheduled phase angle with respect to said crankshaft at a faster rate of movement based on said first, second, and third signals, said controller being further configured to select one of said first and second camshafts having said faster rate of movement for reducing torque fluctuations when changing said faster rate of movement.

6. The system of claim 5 wherein said first, second, and third sensors may comprise one of a hall effect sensor, an optical encoder, or a variable reluctance sensor.

7. An article of manufacture, comprising:

a computer storage medium having a computer program encoded therein for selecting one of first and second phase shiftable camshafts in a variable camshaft timing engine, said first and second camshafts controlling air flow communicating with said first and second cylinders, respectively, of said engine, said engine further including a crankshaft being driven by first and second pistons within said first and second cylinders, respectively, said computer storage medium comprising:

code for determining which of said first and second camshafts is moving at a faster rate of movement toward a first scheduled phase angle with respect to said crankshaft; and, code for selecting one of said first and second camshafts having said faster rate of movement for reducing torque fluctuations when changing said faster rate of movement.

8. The article of manufacture of claim 7 wherein said code for determining which of said first and second camshafts is moving at said faster rate, of said computer storage medium includes:

code for determining whether said first camshaft is being advanced or retarded with respect to a present position of said camshaft;

code for determining a phase angle difference between said first camshaft and said second camshaft with respect to said crankshaft; and, code for indicating which one of said first and second camshafts has said faster rate of movement based on said phase angle difference and whether said first camshaft is being advanced or retarded.

9. The article of manufacture of claim 8 wherein said code for determining whether said first camshaft is being advanced or retarded, of said computer storage medium, includes:

code for determining a present phase angle of said first camshaft with respect to said crankshaft; and, code for comparing said present phase angle with said scheduled phase angle of said first camshaft.

10. The article of manufacture of claim 8 wherein said code for indicating which one of said first and second camshafts has said faster rate of movement, of said computer storage medium, includes:

code for multiplying said phase angle difference value by a positive value if said first camshaft is being advanced or a negative value if said first camshaft is being retarded to obtain a first value, wherein when said first value is a greater than a predetermined threshold value said first camshaft has said faster rate of movement.

* * * * *